US005282320A

United States Patent [19]

Wedinger et al.

[11] Patent Number: 5,282,320

[45] Date of Patent: Feb. 1, 1994

[54] BOOK DRYING PROCESS

[75] Inventors: Robert S. Wedinger; Shawn P. Cavanagh, both of Gastonia; Kent N. Smith, Bessemer City, all of N.C.

[73] Assignee: FMC Corporation, Philadelphia, Pa.

[21] Appl. No.: 749,094

[22] Filed: Aug. 23, 1991

[51] Int. Cl.[5] ..... F26B 7/00

[52] U.S. Cl. ..... 34/12; 34/1 E; 34/1 K

[58] Field of Search ..... 34/1 E, 1 K, 1 L, 1 M, 34/12; 422/186.04

[56] References Cited

U.S. PATENT DOCUMENTS

| | | | |
|---|---|---|---|
| 2,949,677 | 8/1960 | Cameron . | |
| 3,676,182 | 7/1972 | Smith . | |
| 3,952,421 | 4/1976 | Wilson et al. | 34/1 |
| 4,051,276 | 9/1977 | Williams . | |
| 4,103,431 | 8/1978 | Levinson . | |
| 5,038,494 | 8/1991 | Lundquist et al. | 34/92 X |
| 5,120,500 | 6/1992 | Eggersdorfer et al. | 34/4 X |

FOREIGN PATENT DOCUMENTS 911110 10/1972 Canada .

OTHER PUBLICATIONS

Cunha, *Mass Deacidification for Libraries,* Library Technology Reports, May-Jun. 1987, vol. 23, No. 3, pp. 410–440.

*Primary Examiner*—Gerald A. Michalsky
*Assistant Examiner*—Kevin L. Lee
*Attorney, Agent, or Firm*—Charles C. Fellows; Robert L. Andersen

[57] ABSTRACT

The process for deacidification of at least one book or other similarly sized cellulosic product the steps of which include:

a) predrying a plurality of books or other similarly sized cellulosic product;

b) deacidifying the dried plurality of books or another similarly sized cellulosic product using a deacidification solvent solution; and c) drying the deacidified plurality of books or another similarly sized cellulosic product to reduce the solvent content by use of a vacuum, wherein high frequency radiation is used along with either or both steps a) and c) to aid in drying: in which the improvement comprises, dividing the plurality of books or a similarly sized cellulosic product into two or more sections with a material having a high power loss factor to reduce the variation in the high frequency electric field in a high frequency drier and promote uniform heating of at least one book or a similarly sized cellulosic product.

5 Claims, No Drawings

BOOK DRYING PROCESS

This invention concerns an improved method for drying books containing small amounts of water and for drying books that have been wet with solvents in a book deacidification process in which the drying is effected by means of vacuum and heat developed by use of high frequency energy.

A number of processes have been developed to mass deacidify books which are otherwise known to deteriorate during storage due to the presence of small amounts of acid in the paper. The typical "dry-treat-dry" process has been used for years and is well known from Canadian Patent 911110, issued Oct. 3, 1972, which among other things teaches drying books before and after deacidification treatment; this patent predicts dielectric energy might be useful as a heat generating source. Some of these processes employ organomagnesium compounds dissolved in hydrocarbon, hydrochlorofluorocarbons, and/or chlorofluorocarbons which solutions are employed to treat, deacidify, the books. Drying the books to remove small amounts of water is done prior to treatment to improve treatment results.

The present inventors have recognized that because books are not uniform in size or construction serious overheating can occur when using high frequency energy as the source of heat in drying books. It has been noted in the prior art that when drying books temperatures above 50° C. should be avoided. The present inventors have noted that some "tall books" and books that are otherwise ordinary appearing books tend to seriously overheat when subjected to high frequency energy, reaching temperatures of in excess of 204° C. (400° F.) when dried using vacuum and dielectric energy.

Libraries having books to be deacidified wish to remove them in the order they are stored, have them treated and returned to the shelves without a need for sorting the books before or after treatment. Moreover, books that are to be treated are typically placed in a special container that can be sealed by the library and the books treated without being removed from the container. This assures the library that the proper books are returned without the need of a book-by-book check to insure proper book return. There is thus, a need for a method of drying books under vacuum using dielectric energy to heat books of varying height, thickness and construction that does not overheat the books and that avoids the need to sort the books before treatment and drying.

In accord with the present process there is provided an improved process for drying relatively large batches of cellulosic materials such as a plurality of books and documents to remove small amounts of water and or solvents by use of vacuum and warming the cellulosic material with high frequency radiation in the range of 300 kilo Hertz to 400 giga Hertz to internally generate heat wherein the material to be dried in one container or batch is divided into a number of sections separated by materials with high loss factor. While the present process is useful in the drying of cellulosic materials in almost any mass size suitable for treatment, the invention will be further described only with reference to books since books are the largest repository of acid containing cellulosic materials.

Materials having high loss factors are used as spacers in the process of this invention. Some useful materials for spacers or dividers include, but are not limited to, masonite, kynar, phenolics, polyvinylidene chloride, polyvinylchloride, nitrocellulose and materials impregnated with a high loss material such as a cellulose sheet impregnated with phenolic resin and the like.

The placement of the spacers in the load of books to be dried while not highly critical should be placed so as to divide the load into somewhat uniform sections.

The high frequency energy range useful in practicing this invention is that part of the electromagnetic spectrum below the visible and infra red ranges, and useful for internally generating heat in a heating or drying process. The useful frequency range includes microwave and dielectric frequency ranges in the 200 kilo Hertz (kHz) to 600 giga Hertz (gHz) range. Preferred frequency ranges are in the 300 kHz to 500 gHz range. Thus, either a microwave or a dielectric energy source may be employed in the process of this invention.

Solvents useful in the practice of this invention included, but are not limited to, chlorinated hydrocarbons such as chlorofluorocarbons frequently termed Freons TM, low boiling hydrocarbons such as pentane, hexane, cyclohexane, heptane, octane, and the like. Predrying is done to reduce the water level of the cellulosic material to a predetermined level. This is frequently the capacity of the vacuum system at a selected temperature. For example, books are dried under vacuum and mild heating until the system stops removing additional water. Drying after deacidification and removal of excess deacidification solution is similarly done, but can be terminated at some point prior to complete dryness as traces of residual solvent are not objectionable and soon dissipate in the environment.

The deacidification chemicals soluble in non-aqueous solvents are useful in the process of this invention. A preferred class of such chemicals include, but are not limited to, an effective amount of a substituted metal alkoxide of the formula $$X_yM^a(OR)_{a-y}(R^1OH)_x$$

wherein:

(I) —OR is a group selected from 2-alkoxyalkoxy- and ω-alkoxypolyalkoxy- groups of the formula $$[-OCH(R^2)CH_2\text{-}(OCH(R^2)CH_2)\text{-}nOR^3]$$

wherein $R^2$ is selected from H and $-CH_3$ and $R^3$ is selected from alkyl groups of 1 to 18 carbon atoms, cycloalkyl groups of 3 to 18 carbon atoms and aryl, arylalkyl and alkylaryl groups of 6 to 8 carbon atoms and n is a value of zero to 100;

(II) X- is a group selected from (a) alkoxy groups of the formula $-OR^4$ wherein $R^4$ is selected from alkyl groups containing 1 to 18 carbon atoms, cycloalkyl groups containing 3 to 18 carbon atoms and aryl, arylalkyl and alkylaryl groups containing 6 to 18 carbon atoms;

(b) 2-alkoxyalkoxy- and ω-alkoxypolyalkoxy-groups of the formula $$[-OCH(R^2)CH_2\text{-}(OCH(R^2)CH_2)\text{-}nOR^3]$$

wherein $R^2$, $R^3$ and n have the hereintobefore ascribed meanings;

(c) 2-dialkylaminoalkoxy- and ω-dialkylaminopolyalkoxy groups of the formula $$[-OCH(R^2)CH_2-(OCH(R^2)CH_2)_n-NR^3_2]$$

wherein $R^2$, $R^3$ and n have the hereintobefore ascribed meanings;

(d) halogen selected from chlorine and bromine;

(e) alkylcarbonato of the formula $[-OC(O)OR^4]$ wherein $R^4$ has the hereintobefore ascribed meaning and may also be 2-alkoxyalkoxy- and ω-alkoxypolyalkoxy groups of the formula $$[-OCH(R^2)CH_2-(OCH(R^2)CH_2)_n-OR^3]$$

wherein $R^2$, $R^3$ and n have the hereintobefore ascribed meanings;

(f) an organic group $-R^4$ wherein $R^4$ has the hereintobefore ascribed meaning;

(g) an acyloxy group of the formula $[-O(O)CR^4]$ wherein $R^4$ has the hereintobefore ascribed meaning;

(III) M is a metal selected from groups IIa and IIb of the Periodic Table and aluminum and mixtures thereof;

(IV) $R^1OH$ is a compound in which $R^1O$ is a group selected from (h) alkoxy groups of the formula $R^4O$ wherein $R^4$ has the hereintobefore ascribed meanings;

(i) 2-alkoxyalkoxy- and ω-alkoxypolyalkoxy-groups of the formula $$[-OCH(R^2)CH_2-(OCH(R^2)CH)_n-OR^3]$$

wherein $R^2$, $R^3$ and n have the hereintobefore ascribed meanings;

(j) 2-dialkylaminoalkoxy- and ω-dialkylaminopolyalkoxy groups of the formula $$[-OCH(R^2)CH_2-(OCH(R^2)CH_2)_n-NR^3_2]$$

(V) a is the valence of the metal M;

(VI) y has a value between zero and one; and (VII) x has a value of zero to two.

These deacidification chemicals are disclosed in detail in Patent Cooperation Treaty Publication No. WO 90/03466. The most preferred substituted magnesium alkoxide is carbonated magnesium butoxytriglycolate.

The typical book treatment apparatus or plant designed to deacidify books employs a dry-treat-dry process using vacuum and dielectric generated heat. This type process first dries books under vacuum and gentle heat, not exceeding about 60° C., to some predetermined water content then treats the books with a solvent solution of a deacidifying compound, removes excess treating solution and dries the books. Both drying steps employ vacuum and dielectric heating. A suitable dry-treat-dry process and apparatus for treating books is described in detail in Patent Cooperation Treaty Publication No. WO 91/0497, which publication is hereby incorporated by reference.

EXPERIMENTAL

A book deacidification apparatus, built substantially as described in WO 91/04797, was operated over a period of months during which time several thousand books were treated with a deacidification solution containing 2.5 to 5% by-weight carbonated magnesium butoxytriglycolate in a trichlorofluoroethane solution. The books were loaded in plastic containers and several temperature indicating devices placed amongst the books so as to measure the temperature developed in the books during treatment. The filled containers were then subjected to processing substantially in accord with the process as described in WO 91/04797. The container of books was placed in a chamber which was evacuated and to which dielectric energy was applied to dry the books to a predetermined moisture content. The dried books were then treated with the deacidification solution by completely covering the books with the treatment solution in a treatment chamber. Excess solvent solution was removed after treatment and the chamber subjected to vacuum and dielectric energy developed heat to remove remaining solvent from the books.

During operation of the process, it was observed during this same period that when treating books of generally the same size some books would be overheated, some seriously overheated. Careful examination of the book covers revealed that, unlike the uniform pages of a book, covers are often composites and contain numerous materials not generally found in the book pages. Nevertheless, the pages of some books can be dielectrically active, and such pages can char when covers don't char from overheating. The dielectric heating rate of covers was investigated and some were found to heat much more rapidly than others during processing. These quick heating covers were, what is herein referred to as, dielectrically active. The technical definition of a dielectrically active material is a material whose dielectric loss factor is high. The loss factor is the product of the dielectric constant and the loss tangent. The loss factor for various materials is reported in the literature. The more dielectrically active a material is, the faster it will heat up in a dielectric field.

The containers were 20 3/8 by 12¾ by 9¾ inches in which about 20 books were placed with their spines down, opening upward. Dielectrically active spacers or inserts were placed among the books so as to divide each container of books into 15 to 20 sections of about equal size. The books were deacidified in the dry-treat-dry process using vacuum and dielectric generated heat in both drying steps as described above using the apparatus and process described in WO 91/04797. The temperature of the books at numerous points in the container was monitored and the temperatures were found to be generally uniform. This experimental work was repeated with ordinary sized books with both high and low dielectrically active covers. The dielectrically active spacers were found to create a uniform dielectric field in the drying chamber. Aside from avoiding overheating the books the use of dielectrically active spacers reduced the drying time and more uniformly heated and dried the books.

Three lots of books were obtained from a book seller. In one lot, all the books were entitled *A Season Inside*, in the second, *The Great Divide*, and in the third, *The Queen of the Damned*. Two batches of books for deacidification treatment were assembled in separate containers, each batch holding a mix of books taken from each of the three lots of books. Dielectrically active dividers were placed between the books in one container so each book was separated from each other by a divider. The two batches were deacidified as described above with a deacidification solution containing carbonated magnesium butoxytriglycolate. After the drying step, the books entitled *A Season Inside* were found to be charred in the batch without dividers, and none of the books in the batch containing the dielectrically active dividers overheated. Covers of the copies of *A Season Inside*, were determined to have a high power loss factor as they were dielectrically active, and the other book covers were not dielectrically active. These high power loss factor book covers can, and have been, used as dividers.

The experimental work which was used to reduce this invention to practice was conducted in a pilot plant set up and operated substantially in accord with the apparatus and process disclosed in the published Patent Cooperation Treaty patent WO 91/04797. As indicated in this reference, the apparatus can be operated with vacuum chambers containing electrodes capable of producing a dielectric field. While the apparatus of WO 90/04797 employs two vacuum chambers, that process and the present process can be operated using a single vacuum chamber. The high frequency energy range useful in practicing this invention is that portion of the radio frequency range that will generate heat in the books being treated; the preferred frequency range is 500 kHz (kilo Hertz) to 300 gHz (giga Hertz). Both microwave and dielectric frequency ranges can be employed.

What is claimed is:

1. In the process for deacidification of a plurality of books or other similarly sized cellulosic product the steps of which include:

a) predrying a plurality of books or other similarly sized cellulosic product;

b) deacidifying the dried plurality of books or another similarly sized cellulosic product using a deacidification solvent solution; and c) drying the deacidified plurality of books or another similarly sized cellulosic product to reduce the solvent content by use of a vacuum, wherein high frequency radiation is used along with either or both steps a) and c) to aid in drying: in which the improvement comprises, dividing the plurality of books or a similarly sized cellulosic product into two or more sections with a material having a high loss factor to reduce the variation in the high frequency electric field in a high frequency drier and promote uniform heating a plurality of books or a similarly sized cellulosic product.

2. The process of claim 1 wherein the material having a high loss factor is selected from masonite, kynar, phenolic resin, polyvinylchloride resin, polyvinylidene chloride resin, nitrocellulose, and high power loss factor book covers.

3. The process of claim 1 wherein the high frequency radiation is microwave radiation.

4. The process of claim 1 wherein the high frequency radiation is dielectric radiation.

5. The process of claim 1 wherein the deacidification solvent solution is a solution containing carbonated magnesium butoxytriglycolate.

* * * * *